United States Patent [19]

Northcote

[11] 4,389,978

[45] Jun. 28, 1983

[54] GRATES

[75] Inventor: Reginald D. Northcote, Lower Penn, England

[73] Assignee: Parkinson Cowan GWB Limited, Dudlay, England

[21] Appl. No.: 272,035

[22] Filed: Jun. 9, 1981

[30] Foreign Application Priority Data

Jun. 10, 1980 [GB] United Kingdom ..... 8019015

[51] Int. Cl.[3] ..... F22B 1/00

[52] U.S. Cl. ..... 122/4 D; 122/376; 122/374; 110/281; 110/283; 110/284

[58] Field of Search ..... 122/371.4 D, 374–378; 110/281–284, 248–249

[56] References Cited

U.S. PATENT DOCUMENTS

| | | | |
|---|---|---|---|
| 675,153 | 5/1901 | Fry | 122/374 |
| 675,884 | 6/1901 | Dean | 110/248 |
| 879,492 | 2/1908 | Richardson | 122/374 |
| 1,180,287 | 4/1916 | Fortune | 110/283 |
| 1,321,335 | 11/1919 | Roach et al. | 110/284 |
| 1,352,467 | 9/1920 | Miller | 110/283 |
| 1,438,190 | 12/1922 | Skelly | 110/281 |
| 1,487,078 | 3/1924 | Roach | 110/283 |
| 1,585,449 | 5/1926 | Welsh | 122/371 |
| 3,263,655 | 8/1966 | Robson, Jr. | 122/376 |
| 4,270,468 | 6/1981 | Robinson et al. | 122/4 D |
| 4,273,073 | 6/1981 | Robinson | 122/4 D |

FOREIGN PATENT DOCUMENTS

| | | |
|---|---|---|
| 344406 | 11/1921 | Fed. Rep. of Germany . |
| 2001156 | 1/1979 | United Kingdom . |

*Primary Examiner*—Henry C. Yuen

*Attorney, Agent, or Firm*—Spencer & Kaye

[57] ABSTRACT

A grate characterized in that a fuel supporting and conveying surface is provided comprising at least one elongate channel having an open mouth and a bottom, the or each of said channels having a transverse cross-section which decreases in width in a direction extending away from the open mouth towards the bottom of the channel, air feed opening means to feed air to the interior of the channel at least in the region of the bottom thereof, and means mounting the channel to permit the channel to be vibrated to cause fuel to be conveyed along the channel and longitudinally of the grate.

13 Claims, 8 Drawing Figures

10
11
12
13
14
15
16
17
18
32
33
34
35
40
41
42
44
45
46
48
53
54
55
56

GRATES

BACKGROUND OF THE INVENTION

This invention relates to a grate particularly, but not exclusively, to a grate for use in a boiler.

An object of the invention is to provide a new and improved grate, in particular one which is suitable for burning material of relatively small particle size.

SUMMARY OF THE INVENTION

According to one aspect of the invention we provide a grate having a fuel supporting and conveying surface comprising at least one elongate channel having an open mouth and a bottom, the or each of said channels having a transverse cross-section which decreases in width in a direction extending away from the open mouth towards the bottom of the channel, air feed opening means to feed air to the interior of the channel at least in the region of the bottom thereof, and means mounting the channel to permit the channel to be vibrated to cause fuel to be conveyed along the channel and longitudinally of the grate.

According to another aspect of the invention we provide a grate having a fuel supporting and conveying surface comprising at least one elongate channel having an open mouth and a bottom, an air feed opening to feed air to the interior of the channel in the region of the bottom thereof, baffle means to prevent egress of fuel through said opening and means mounting the channel to permit the channel to be vibrated, in use, to cause fuel to be conveyed along the channel and longitudinally of the grate.

The or each of said channels may have a transverse cross-section which decreases in width in a direction extending away from the open mouth towards the bottom of the channel.

In either of the above aspects of the invention:

The or each channel may be of V-shape or generally of V-shape in said cross-section.

The included angle of the or each channel may decrease towards a discharge end of the grate.

Said fuel supporting and conveying surface may comprise a plurality of said channels arranged side-by-side transversely of the grate.

The channel defining elements may all be mounted on a rigid frame and the rigid frame may be mounted for vibration so that, in use, the channel or all the channels vibrate as a single unit.

The grate may be provided in a shell-type boiler comprising an outer shell within which is contained the steam and/or water space of the boiler, a furnace and preferably a plurality of smoke tubes for passage therethrough of the products of combustion of the furnace, the said grate being provided within said furnace to fire the furnace.

The boiler may have apparatus for feeding solid fuel onto the grate through a feed opening in the front of the boiler.

Alternatively the boiler may have apparatus for feeding solid fuel onto the grate downwardly through the steam and/or water space of the boiler.

The boiler may be provided with means to feed burnt fuel from the grate through the shell, preferably said means feed the burnt fuel through the shell at or adjacent the back end of the boiler.

The grate may be mounted on flexible mountings extending through the bottom of the shell and fixed to a rigid support outwardly of the shell.

The grate may be vibrated by at least one motor located outwardly of the shell.

Flexible sealing means are provided where said supports and drive means extend through the shell.

Means may be provided to control the amplitude and/or speed of vibration of the grate thereby controlling the rate of fuel feed and hence the rate of combustion.

In one alternative of either of the above aspects of the invention:

The or each channel may comprise a pair of spaced apart side walls, a base part, an air feed opening between at least one side wall, and preferably between both side walls, and the base part and a or said baffle means extending upwardly from the base part outwardly of the or each side wall to a position above the bottom of the associated side wall or walls.

Preferably the or each baffle and associated side wall overlap so that the baffle terminates at a position approximately half way between the top and bottom of the channel.

The side walls of the or each channel may extend downwardly and inwardly to define said generally V-shape cross-section.

Where a plurality of channels are provided, the tops of adjacent side walls of adjacent channels may be connected together.

The connected together adjacent side walls may comprise an inverted V-section assembly and the base part and baffles of each channel may be connected together to provide a V-shaped in section assembly.

The grate may be water cooled.

A lower water cooling pipe may be provided for the base part of the or each channel and an upper water cooling pipe may be provided for the top of each wall of the or each channel.

The base part may comprise said lower water cooling pipe and the baffle means may comprise plates fixed to the pipe and diverging upwardly and outwardly therefrom and the side walls of adjacent channels may be fixed to said upper water cooling pipe to diverge downwardly and outward therefrom.

The grate may be provided with side members to retain fuel on said surface.

The side members may be provided with air feed openings and baffle means to prevent egress of fuel therethrough.

The side members, baffles and air feed openings may be provided by means of a first set of longitudinally spaced apart plates and a second set of longitudinally spaced apart plates, the plates of the second set being positioned outwardly of and overlapping the plates of the first set.

The side members may be water cooled.

In another alternative of either of the above aspects of the invention:

The or each channel may comprise a pair of spaced apart side walls connected at their lower ends to a base part, a plurality of air feed perforations in said side walls, an air feed chamber, having a peripheral wall, beneath said side walls, an air feed opening in said peripheral wall and a or said baffle means extending in said chamber transversely above said opening.

Where a plurality of channels are provided, said chamber may be provided with an air feed opening beneath the adjacent side walls of adjacent channels.

Means may be provided to permit of egress of fuel from the interior of said chamber at a discharge end of the grate.

The side walls of the or each channel may extend downwardly and inwardly to define said generally V-shape cross-section.

Where a plurality of channels are provided, the tops of adjacent walls of adjacent channels may be connected together.

The connected together adjacent side walls may comprise an inverted V-section assembly.

A lower water cooling pipe may be provided for the base part of the or each channel and an upper water cooling pipe may be provided for the top of each wall of the or each channel.

The base part may comprise said lower water cooling pipe and the side walls may comprise plates fixed to said lower pipe and diverging upwardly and outwardly therefrom, and top edges of said plates of adjacent channels may be fixed to said upper water cooling pipe to diverge downwardly and outwardly therefrom.

The grate may be provided with side members to retain fuel on said surface.

The side members may be provided with a plurality of air feed performations.

The side members may be water cooled.

Where side members are provided, said air feed chamber may be provided with an extension part laterally outwardly of the side walls and may be provided with a top closure member to provide a passageway for air between the top closure member and the top of said side walls.

BRIEF DESCRIPTION OF THE DRAWINGS

Two embodiments of the invention will now be described in more detail by way of example, with reference to the accompanying drawings wherein.

DESCRIPTION OF THE PREFERRED EMBODIMENTS

Figure 1:
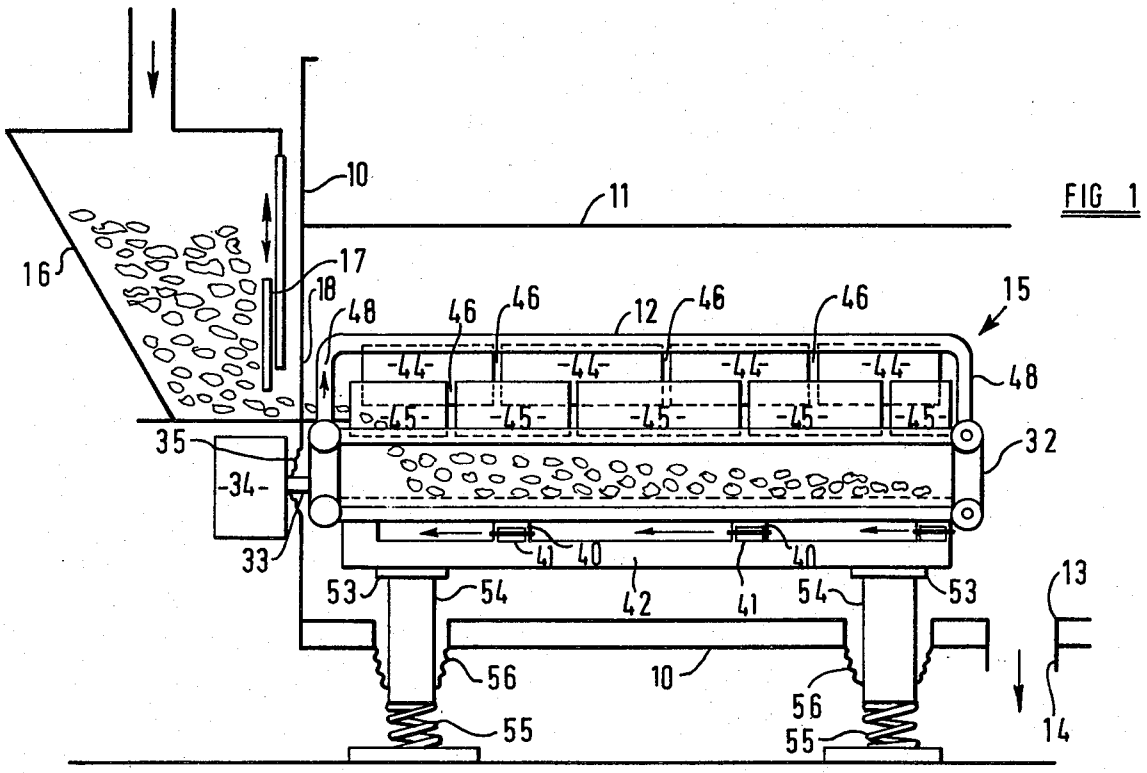
FIG. 1 is a diagrammatic fragmentary longitudinal cross-sectional view through a boiler embodying the invention.

Referring to FIGS. 1 to 5 of the drawings, the shell of a shell boiler is indicated at 10 and within the shell is located a furnace chamber 11 of generally cylindrical configuration having a grate 12 disposed thereon. Adjacent the rear end, the furnace tube 11 has an opening 13 which communicates with a duct 14 through the shell 10 to permit exit of ash discharged from the exit end 15 of the grate 12.

A hopper 16 is located outside the boiler shell 10 at the front and is provided with a discharge control door 17 to permit fuel to be fed through a feed opening 18 into the interior of the furnace tube 11 and onto the grate 12.

The construction of the boiler other than the grate may follow conventional practice for example, if desired, one or more passes of smoke tubes may be provided extending between smoke boxes provided, as appropriate, at the front and rear of the shell.

Also, if desired, instead of the hopper fuel feed arrangement illustrated in the drawing, the fuel supply tube may extend downwardly through the shell 10 and the water/steam space adjacent the front of the boiler to permit coal or other solid fuel to be fed downwardly through the shell and water/steam space onto the grate 12, suitable fuel feed apparatus being provided within the tube.

The grate 12 comprises a plurality of generally V-shaped channels 20 arranged transversely of the grate and each channel extending longitudinally of the grate, with an air feed opening 21 at the base of each channel and baffle means 22 are provided to prevent egress of fuel through the openings 21.

Figure 3:
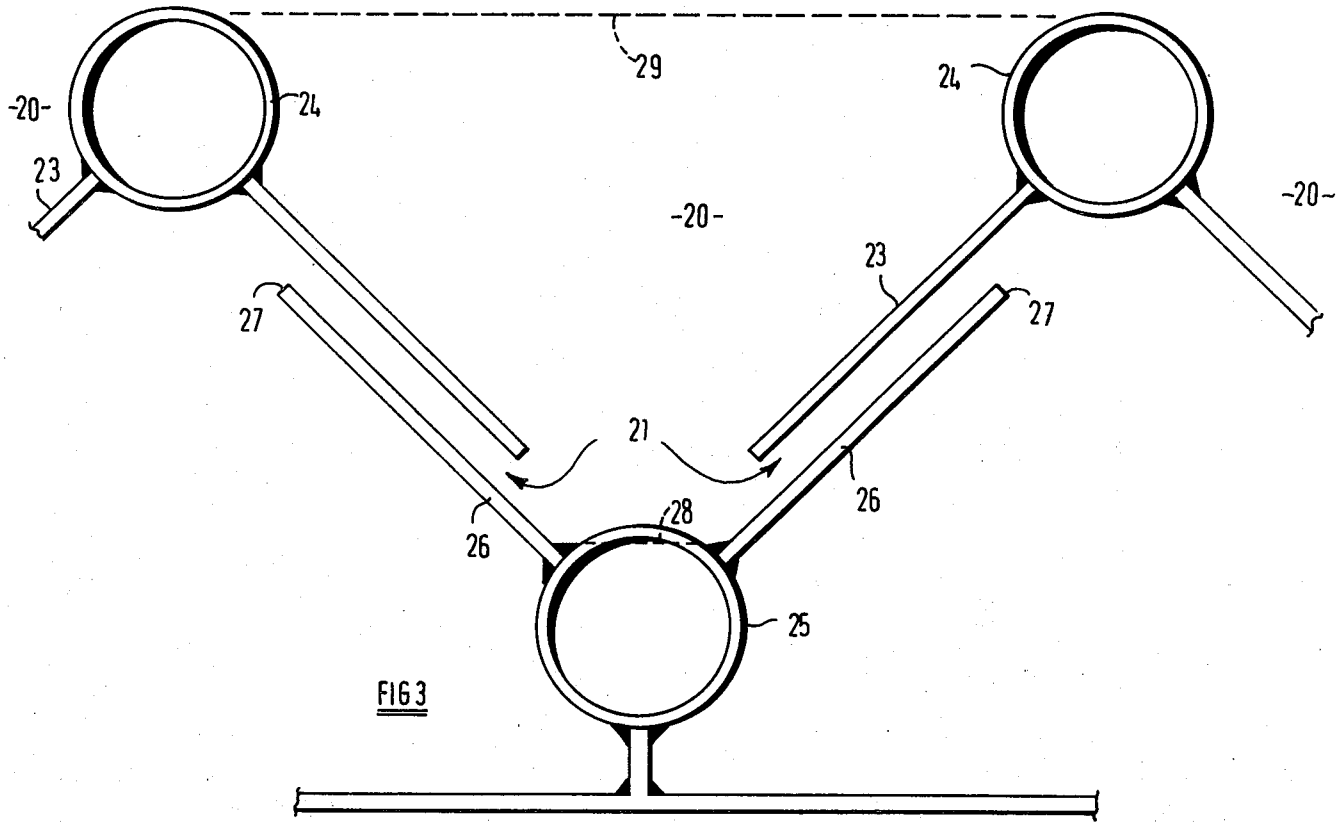
FIG. 3 is a fragmentary view of part of FIG. 2 drawn to an enlarged scale.

Referring particularly to FIG. 3, the side walls 23 of each channel comprise unperforated generally rectangular plates welded to a water cooling pipe 24 so that the plates providing the side walls of adjacent channels 20 diverge downwardly and outwardly from the associated pipe 24.

The base of each channel is provided by a further water cooling pipe 25 from which further generally rectangular unperforated plates 26 diverge upwardly and outwardly to provide the baffle means. It will be seen that the upper end 27 of each baffle 26 terminates at a position approximately mid-way between the bottom 28 of the channel and the top 29 thereof.

Figure 4:
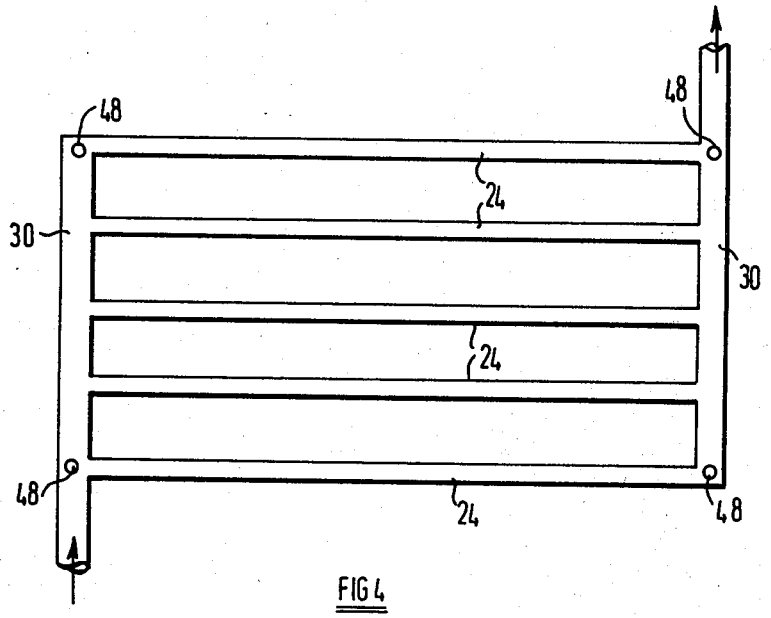
FIG. 4 is a diagrammatic plan view showing part of the water cooling arrangement of the grate of the boiler of FIG. 1.
Figure 5:
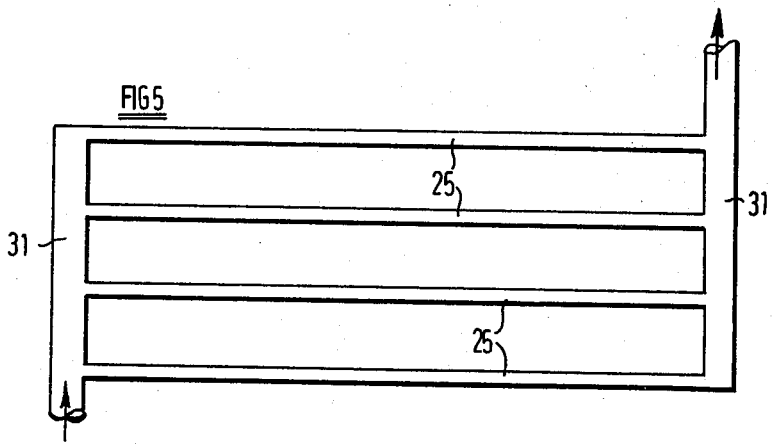
FIG. 5 is a diagrammatic plan view showing another part of the water cooling arrangement of the grate of the boiler of FIG. 1.

As best shown in FIGS. 4 and 5, the upper pipes 24 are connected to laterally extending manifolds 30, one at the front and the other at the rear of the grate and are thereby rigidly connected together and suitable flexible water supply and exit connections (not shown) are made to the manifolds 30. Similarly the lower water pipes 25 are connected to front and rear manifolds 31 likewise connected to flexible water supply and exit connections (not shown) and are similarly likewise connected together. The manifolds 30 and 31 are connected together by suitable members 32 and the front member 32 is connected by a link 33 to a vibrator unit 34 located outwardly of the boiler shell, there being a suitable flexible seal between the shell 10 and the link 34.

Figure 2:
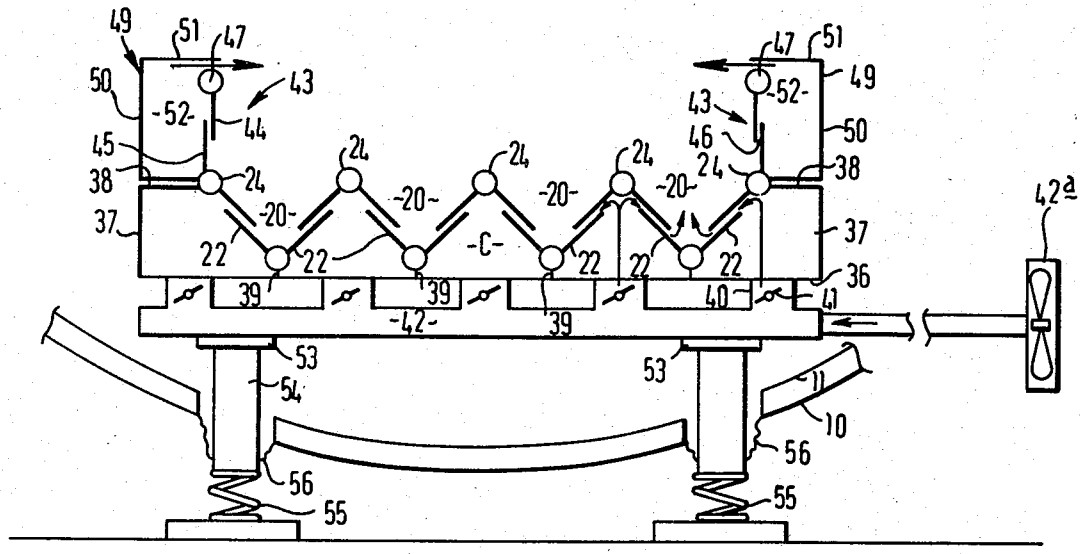
FIG. 2 is a diagrammatic fragmentary transverse cross-sectional view to an enlarged scale through the boiler of FIG. 1.

As best shown in FIG. 2, the parts of the grate thus far described are partly enclosed within a box comprising a base 36, side walls 37 and inturned flanges 38 which are fixed to the end ones of the upper water pipes 24. The box thus provides an air feed chamber C beneath the channels 20. Partitions 39 extend between each lower water supply pipe 25 and the base 36 and air supply ducts 40 provided with valves 41 extend from apertures formed in the base 36 between the partitions 39 and communicate with a plenum chamber 42 to which primary air is fed via suitable feed means 42*a*.

As shown in FIG. 2 the primary air follows the path indicated by the arrows and hence is fed into the base of each channel 20.

Operation of the valves 41 permits control of the amount and distribution of the primary air transversely of the grate and the baffle plates 26 are arranged so that the space between each baffle plate 26 and side wall plate 23 provides the desired distribution of air longitudinally of the grate for example, the gap may decrease towards the exit end 15 of the grate thereby reducing the flow of air towards the discharge end.

Above the water supply pipes 24, side plates 43 are provided in the form of two sets of overlapping plates 44 and 45, the first set 44 being disposed inwardly of the second set and being spaced apart longitudinally so as to provide a space 46 therebetween and the plates 45 likewise having a space 46 therebetween. The plates of the first set 43 depend downwardly from side plate water cooling pipes 47 whilst the plates 45 extend upwardly from the upper water cooling pipes 24. The side plate water cooling pipes 47 are connected by vertical pipes 48 to the manifolds 30.

An enclosure 49, which provides a continuation of the air feed chamber C, is provided for each side plate assembly comprising a side wall member 50 formed as an extension of the members 37 and an upper horizontal closure member 51 spaced closely above the side plate cooling pipe 47.

Air is fed from the chamber C to the interior of the space 52 thus formed which can exit through the gaps 46 between the plates of the sets 44 and 45 and above the pipes 47 to provide secondary air for combustion.

The lower water feed pipes 25 are mounted on transversely extending beams 53 which are supported on rigid struts 54 which extend downwardly through the lower end of the furnace tube 11 and of the boiler shell 10 and are mounted on coil compression springs 55 anchored to a rigid support such as the ground or boiler base. A flexible seal 56 is provided between the boiler shell and the struts 54.

Figure 6:
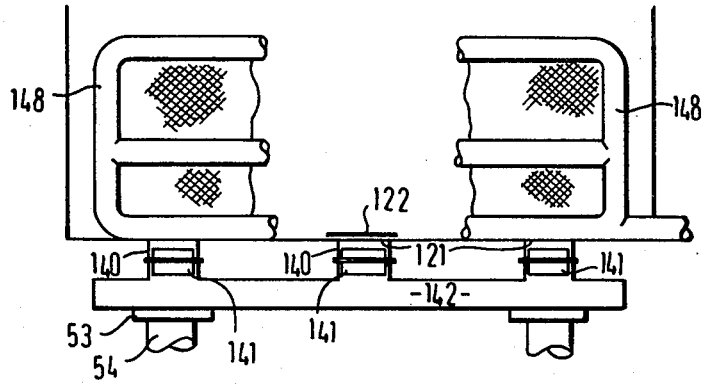
FIG. 6 is a diagrammatic fragmentary longitudinal cross-sectional view through a grate for use in a boiler and illustrates a second embodiment of the invention.
Figure 7:
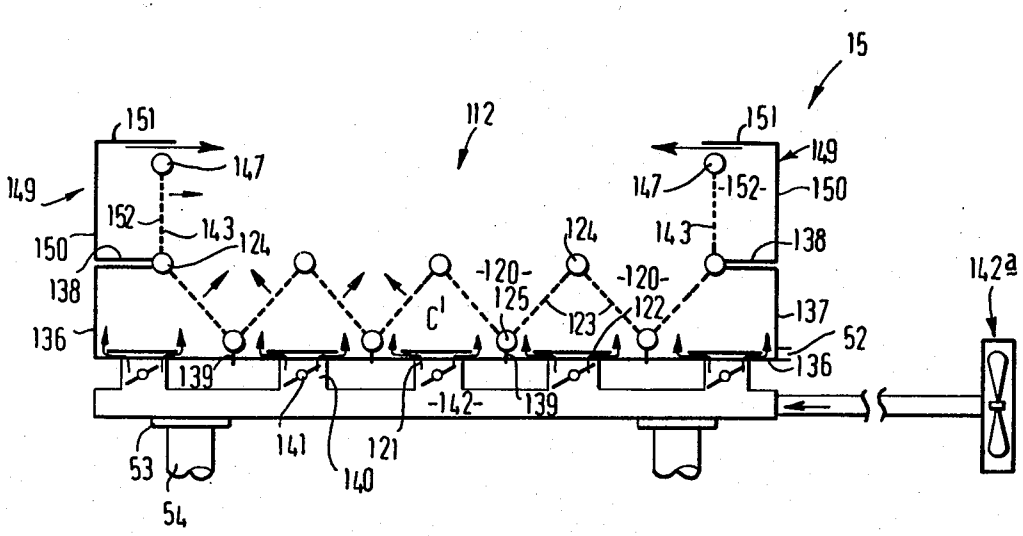
FIG. 7 is a view similar to that of FIG. 2 but illustrating the second embodiment of the invention.

Referring now to FIGS. 6 and 7 of the drawings in which is illustrated a second embodiment of the invention, which is generally similar to that of the first embodiment except for the detailed construction of the grate. In this embodiment the grate 112 is disposed within the furnace chamber 11 in an exactly similar manner to that of the first embodiment and only features of difference, i.e. the detailed features of the grate, will be described hereinafter.

The grate 112 comprises a plurality of generally V-shape channels 120 arranged transversely of the grate and each channel extending longitudinally of the grate. In this embodiment, an air feed opening 121 is provided beneath the side walls of adjacent channels and baffle means 122 are provided to prevent egress of fuel through the openings 121.

Each channel 120 has side walls 123 comprising perforated generally rectangular plates welded to an upper water cooling pipe 124 so that the plates providing the side walls of adjacent channels 120 diverge downwardly and outwardly from the associated pipe 124. The lower edge of each side wall plate is welded to a lower water cooling pipe 125 so that the plates diverge upwardly and outwardly therefrom. The upper and lower pipes 124, 125, are connected to manifolds in an exactly similar manner to the upper and lower pipes 24, 25 of the first embodiment.

Again, as in connection with the first embodiment, the parts of the grate thus far described are partly enclosed within a box comprising a base 136, side walls 137, inturned flanges 138 which are fixed to the end ones of the upper water pipes 124. The box thus again provides an air feed chamber C1 beneath the channels 120. Partitions 139 extend between each lower water supply pipe 125 and the base 136 and air supply ducts 140 provided with valves 141 extend from the air feed openings 121 formed in the base 136, between the partitions 139 and communicate with a plenum chamber 142 to which primary air is fed by suitable feed means **142*a*. As shown in FIG. 7, the primary air follows a path indicated by the arrows around the baffles 122 and through the perforations in the plates 123 and hence is fed into each channel 120. Operation of the valves 141 permits control of the amount of distribution of the primary air transversely of the grate and the baffle plates 122 and/or the density of perforation of the plates 123 provides the desired distribution of air longitudinally of the grate. For example, the gap provided by the baffle plates 122 and/or the density of perforation may decrease towards the exit end 15** of the grate thereby reducing the flow of air towards the discharge end.

Above the upper water supply pipes 124, side plates 143 are provided which again comprise perforated plates. The perforated side plates 143 and the perforated plates which provide the side walls 123 of each channel are preferably made of stainless steel.

The side plates 143 depend downwardly from side plate water cooling pipes 147 and are connected at their lower ends to the upper water cooling pipes 124. The side plate water cooling pipes 147 are connected by vertical pipes 148 to the manifold as described in connection with the first embodiment.

An enclosure 149 providing a continuation of the air feed chamber C1 is provided for each side plate and comprises a side wall member 150 formed as an extension of the members 137 and an upper horizontal closure member 151 spaced closely above the side plate cooling pipe 147.

Air is fed from the chamber C1 to the interior of the space 152 thus formed and can exit through the perforations in the plates 143 and through the gap between the pipes 147 and horizontal closure member 151 to provide secondary air for combustion.

As in the case of the first embodiment, the lower water pipes 125 are mounted on transversely extending beams 53, supported on rigid struts 54 which extend downwardly through the lower end of the furnace tube 11 and are mounted on coil compression springs, all as in the first embodiment.

The flow rate of the air through the perforations in the plates 123 and 143 prevents a substantial amount of ash from the interior of the channels 120 passing through the plates into the chamber C1.

Such ash dust as does pass through the perforations of the plates into the chamber C1 is prevented from egressing through the openings 121 into the ducts 140 by the baffle plates 122. The ash dust in the chamber C1 is transported along the plate 136 towards the discharge end of the grate where it leaves via an opening **152*a* and falls with the remainder of the ash on the discharge end of the channels 120 through the duct 14** described in connection with the first embodiment.

Figure 8:
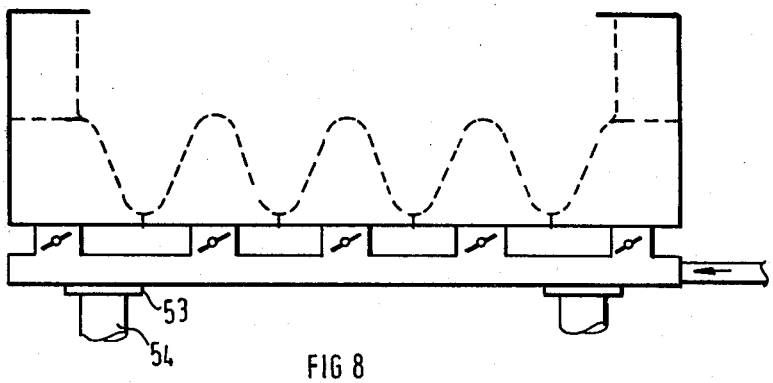
FIG. 8 is another view similar to that of FIG. 2 but illustrating a third embodiment of the invention.

Referring now to FIG. 8, there is illustrated part of a third embodiment of the invention which is similar to the second embodiment in that the troughs are made up of perforated plates, but in this case the grate is not water cooled and hence the fuel supporting and conveying surface of the grate is made of a steel plate formed to a generally sinusoidal configuration as illustrated in FIG. 8. Except for the absence of separate perforated plates joined to water cooling pipes, the grate of the third embodiment is as described in connection with the first and second embodiments.

Although in the example illustrated the stainless steel plate has been described as being of sinusoidal configuration, it could be made of more precise V-configuration if desired and could be made by welding or otherwise joining individual planar plates at their adjacent lower and upper edges to provide a V-shaped configuration.

In all embodiments, if desired, the width of the channels, i.e. the included angle between the side walls thereof, may reduce towards the discharge end of the grate in order to concentrate ash and any remaining combustible material. In addition, a water cooled dam is preferably provided at the discharge end of the grate so as to increase the residence time of the fuel at the discharge end.

The ash discharged from the exit end of the grate passes through the hereinbefore described duct 14 and after passage through a rotary valve is collected. Although generally V-shaped channels have been described, if desired the channels may be of other configuration and the number of channels provided transversely of the grate may be varied as desired.

I claim:

1. A grate having a fuel supporting and conveying surface comprising a plurality of elongate longitudinally-oriented channels, each of said channels having an open mouth and a bottom and being longitudinally stepless and having a transverse cross-section which decreases in width in a direction extending away from the open mouth towards the bottom of the channel, said channels being arranged side-by-side transversely of the grate, a plurality of air feed openings each being provided to permit the interior of a respective one of the channels, in use, to be fed with air from an air supply at least in the region of the bottom of that channel, a plurality of adjustment means each being provided to permit adjustment of a respective one of said air feed openings to adjust the air supply transversely of the grate across the entire width of the grate, and means mounting said channels being provided to permit said channels to be vibrated, in use, to cause fuel to be conveyed along one or more of said channels and longitudinally of the grate, wherein the grate is provided in a shell-type boiler comprising an outer shell within which is contained a steam water space of the boiler and a furnace, said grate being provided within said furnace to fire the furnace, and said broiler having an apparatus for feeding solid fuel onto the grate.

2. A grate having a fuel supporting and conveying surface comprising a plurality of elongate longitudinally-oriented channels, each of said channels having an open mouth and a bottom and being longitudinally stepless, said channels being arranged side-by-side transversely of the grate, a plurality of air feed openings each being provided to permit the interior of each channel, in use, to be fed with air from an air supply in the region of the bottom of that channel, a plurality of adjustment means each being provided to permit adjustment of a respective one of said air feed openings to adjust the air supply transversely of the grate across the entire width of the grate, baffle means being provided to prevent egress of fuel through each such air feed opening, and means mounting said channels being provided to permit said channels to be vibrated, in use, to cause fuel to be conveyed along one or more of said channels and longitudinally of the grate, wherein the grate is provided in a shell-type boiler comprising an outer shell within which is contained a steam water space of the boiler and a furnace, said grate being provided within said furnace to fire the furnace, and said boiler having an apparatus for feeding solid fuel onto the grate.

3. A water cooled grate having a fuel supporting and conveying surface comprising a plurality of elongate longitudinally-oriented channels, each of said channels including upper water cooling pipes, a lower water cooling pipe which forms a base part of the channel and a pair of spaced apart side walls connected at their lower ends to said base part and connected at their upper ends to a respective one of said upper pipes, the walls of each channel being provided with a plurality of air feed perforations, each said channel having an open mouth and a bottom and being longitudinally stepless and having a transverse cross-section which decreases in width in a direction extending away from the open mouth towards the bottom of the channel, said channels being arranged side-by-side transversely of the grate; a plurality of air feed chambers each having a peripheral wall disposed beneath the side walls of the respective channels, at least one air feed opening provided in each peripheral wall to permit the interior of each channel in use, to be fed with air from an air supply at least in the region of the bottom of that channel; a plurality of adjustment means each being provided to permit adjustment of a respective one of said air feed openings to adjust the air supply transversely of the grate across the entire width of the grate; a plurality of baffle means such extending in a respective one of said chambers transversely to a respective one of said air feed openings; and means mounting said channels being provided to permit said channels to be vibrated, in use, to cause fuel to be conveyed along one or more of said channels and longitudinally of the grate.

4. A water cooled grate having a fuel supporting and conveying surface comprising a plurality of elongate longitudinally-oriented channels, each of said channels including upper water cooling pipes, a lower water cooling pipe which forms a base part of the channel and a pair of spaced apart side walls connected at their lower ends to said base part and connected at their upper ends to a respective one of said upper pipes, the walls of each channel being provided with a plurality of air feed perforations, each said channel having an open mouth and a bottom and being longitudinally stepless, said channels being arranged side-by-side transversely of the grate; a plurality of air feed chambers each having a peripheral wall disposed beneath the side walls of the respective channels, at least one air feed opening provided in each peripheral wall to permit the interior of each channel, in use, to be fed with air from an air supply in the region of the bottom of that channel; a plurality of adjustment means each being provided to permit adjustment of a respective one of said air feed openings to adjust the air supply transversely of the grate across the entire width of the grate; baffle means being provided in each chamber and extending transversely to said at least one air feed opening to prevent egress of fuel through each such air feed opening; and means mounting said channels being provided to permit said channels to be vibrated, in use, to cause fuel to be conveyed along one or more of said channels and longitudinally of the grate.

5. A grate according to claim 2 or 4 wherein each channel has a transverse cross-section which decreases in width in a direction extending away from the open mouth towards the bottom of that channel.

6. A grate according to claim 1, 2, 3 or 4 wherein each channel is of V-shape or generally of V-shape, and in said cross-section the included angle of each channel decreases towards a discharge end of the grate.

7. A grate according to claim 1, 2, 3 or 4 wherein the channel defining elements are all mounted on a rigid frame, the rigid frame being mounted for vibration so that, in use, a channel or all the channels vibrate as a single unit.

8. A grate according to claim 1 or claim 2 wherein the shell-type boiler includes a plurality of smoke tubes for passage therethrough of the products of combustion of the furnace.

9. A grate according to claim 8 wherein the grate is mounted on flexible mountings extending through the bottom of the shell and fixed to a rigid support outwardly of the shell, means to vibrate the grate located outwardly of the shell.

10. A grate according to claim 8 wherein means are provided to control the amplitude and/or speed of vibration of the grate thereby controlling the rate of fuel feed and hence the rate of combustion.

11. A grate according to claim 3 or 4 wherein each said chamber is provided with an air feed opening beneath the adjacent side walls of adjacent channels.

12. A grate according to claim 3 or 4 wherein the tops of adjacent walls of adjacent channels are connected together to provide an inverted V-section assembly.

13. A grate according to claim 3 or 4 wherein the grate is provided with side members to retain fuel on each said surface, said air feed chamber being provided with an extension part laterally outwardly of the side members and is provided with a top closure member to provide a passageway for air between the top closure member and the top of said side members.

* * * * *